United States Patent [19]

Biggs et al.

[11] Patent Number: 5,018,057

[45] Date of Patent: May 21, 1991

[54] TOUCH INITIATED LIGHT MODULE

[75] Inventors: John D. Biggs, Danville; Kenneth M. Twain, Oakland, both of Calif.

[73] Assignee: Lamp Technologies, Inc., Danville, Calif.

[21] Appl. No.: 466,467

[22] Filed: Jan. 17, 1990

[51] Int. Cl.[5] ..... F21V 23/00

[52] U.S. Cl. ..... 362/295; 362/156; 362/200; 362/394

[58] Field of Search ..... 362/155, 156, 200, 221, 362/276, 295, 394, 802

[56] References Cited

U.S. PATENT DOCUMENTS 3,590,234 6/1971 Bartick ..... 362/802 X 4,872,095 10/1989 Dubak et al. ..... 362/802 X

*Primary Examiner*—Stephen F. Husar

*Attorney, Agent, or Firm*—Owen, Wickersham & Erickson

[57] ABSTRACT

A light module adapted to provide light temporarily in a confined space comprises a generally oblong and relatively thin housing that retains a bulb for providing a source of light, a power source sufficient to activate the bulb, and an electrical control circuit. The circuit includes a touch sensitive sensor for closing a circuit between the bulb and the power source to turn on the bulb, and a timer for opening the circuit to automatically turn off the bulb after it has been on for a predetermined period of time. The circuit also contains elements for requiring the sensor to be touched twice within a limited time period in order to activate the bulb.

7 Claims, 3 Drawing Sheets

TOUCH INITIATED LIGHT MODULE

This invention relates to illumination devices and more particularly to a self contained, touch initiated light module for illuminating space limited enclosures or other normally dark locations that are not conveniently reached with conventional lighting or which may become darkened due to emergency conditions.

BACKGROUND OF THE INVENTION

In many complicated mechanisms and apparatus it is necessary to perform periodic, visual inspections of certain components located in normally dark areas. Often such inspection points are difficult to reach with conventional lighting even though an illumination of the area for only a relatively short period is required to perform the inspection. Similar temporary lighting is also often needed for dark areas such as closets, drawers, safes and the like. Small lighting devices for handbags using conventional on-off switches have been described, for example in U.S. Pat. Nos. 2,304,387 and 3,239,658. However, the need arose for a compact lighting module which could be easily installed in a variety of locations, could be easily controlled with a relatively simple turn-on switch and a timed automatic turn off switch which would provide ample illumination for a pre-selected period of time and yet conserve battery power. A general object of the present invention is to provide a lighting module that solves these aforesaid problems.

Another object of the present invention is to provide a touch initiated, timed turn-off light module that provides a relatively high degree of illumination and yet is compact and easy to install at a variety of pre-selected locations.

Still another object of the invention is to provide a lighting module having no moving parts which utilizes only solid state components and therefore is particularly well adapted for ease and economy of manufacture.

Another object of the invention is to provide a compact lighting module which can be turned on by a touch or proximity sensor and will turn itself off after a predetermined period of time.

SUMMARY OF THE INVENTION

In accordance with the principles of the invention, a lighting module is provided which may have any desired shape but is generally oblong and relatively narrow in thickness. The module contains an illumination means or light source such as an emitter or bulb within a reflecting chamber connected through a control circuit to a battery. The bulb directs light outwardly from a front side of the module whose rear side is provided with a means to secure it to a fixed structure at the lighting location. Packaged within the module is the miniaturized solid state control circuit which includes a touch or proximity sensor for completing the circuit to the battery and thereby turning on the light bulb. In a preferred embodiment of the invention, the control circuit is programmed so that the proximity sensor must be touched twice within two seconds in order to close the turn-on circuit between the light source and the battery. Once the light turns on, a timing means is activated so that after a predetermined period of time, the circuit switch will open automatically to turn off the light. The entire control circuit including the proximity switch including the turn-on logic and the time duration for automatic turn-off is preferably provided on a single integrated circuit device connected between the light source and the battery. In a typical installation the light module has an attachment means such as an adhesive material or a mechanical clip that enables it to be easily secured to various structural materials.

Other objects, advantages and features of the invention will become apparent from the following detailed description of one embodiment thereof presented in conjunction with the accompanying drawing.

DETAILED DESCRIPTION OF EMBODIMENT

Figure 1:
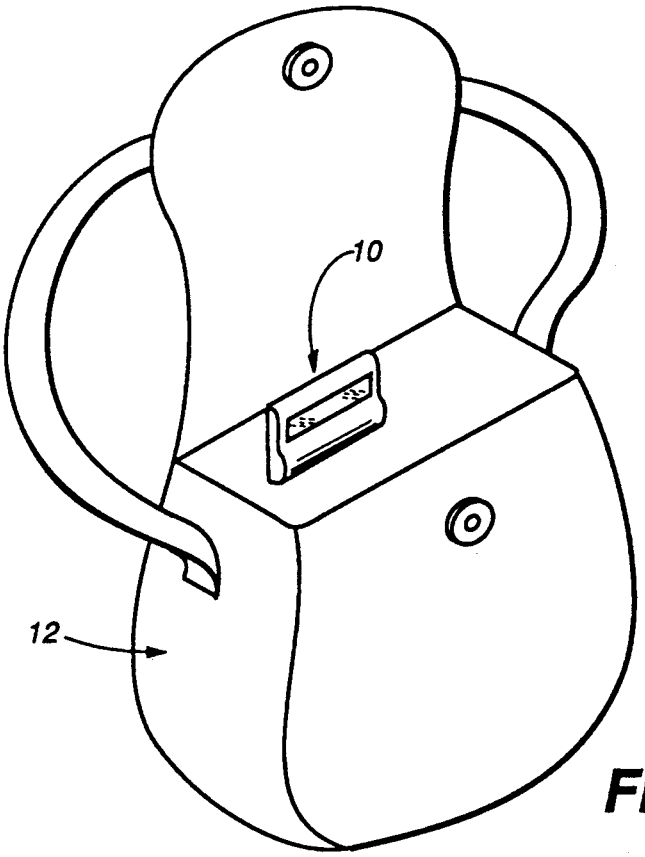
FIG. 1 is a view of a light module according to the present invention as it appears when installed in a purse.

With reference to the drawing, FIG. 1 shows a light module 10 according to the invention as it appears typically in a purse 12 where often a temporary light source is highly useful if not essential. The light module 10 may also be used in many other types of installations or locations where additional light is required.

Figure 2:
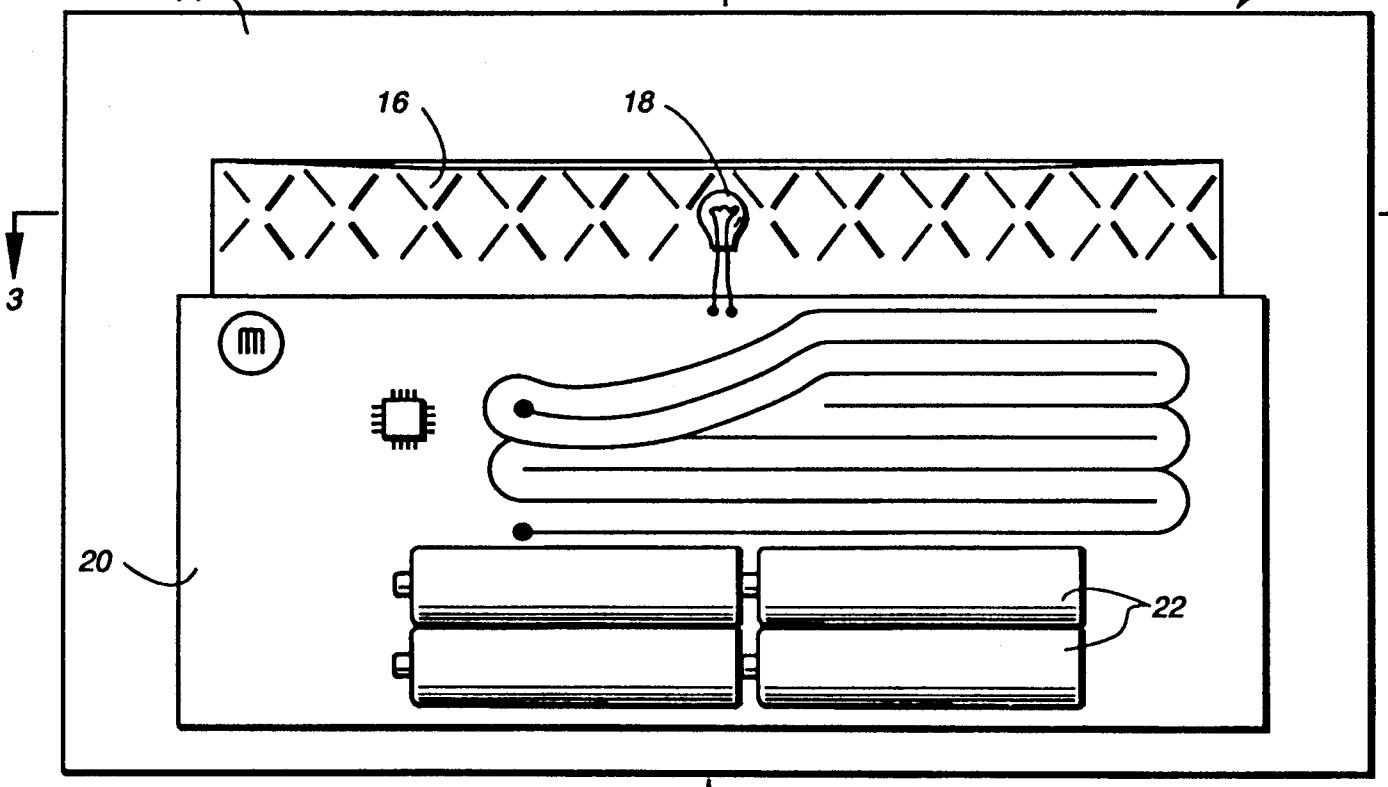
FIG. 2 is a front view of a light module embodying principles of the present invention, with its front cover removed to show internal components.

As shown in FIG. 2, the module 10 in general comprises a relatively narrow, oblong shaped case or housing 14 within which is a reflective chamber 16 for a light bulb 18, a circuit board 20 for supporting various electrical and sensor elements forming an on-off control system and a series of batteries 22 connected through the circuit board to the light bulb 18.

Figure 3:
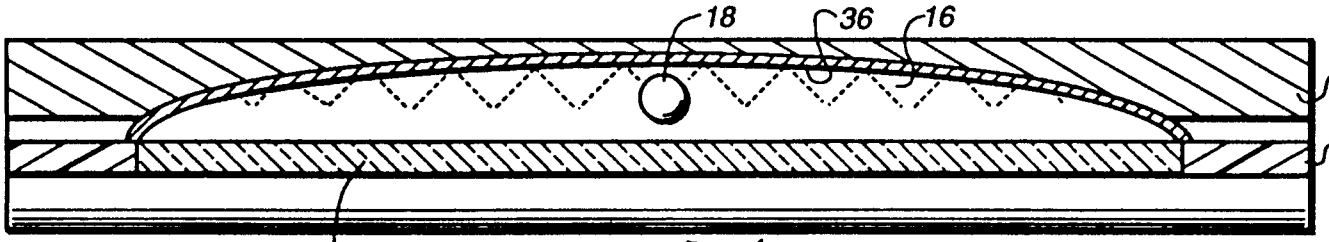
FIG. 3 is a view in section taken along line 3—3 of FIG. 2.
Figure 4:
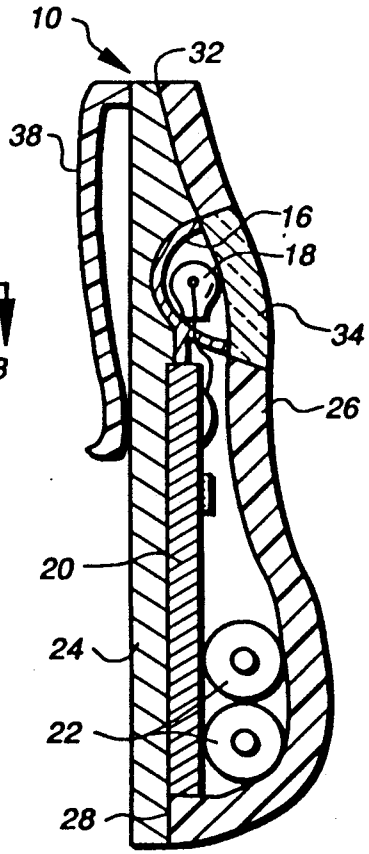
FIG. 4 is a view in section taken along line 4—4 of FIG. 2.

In the embodiment shown in FIGS. 3 and 4, the housing 14 is preferably structurally comprised of a relatively rigid base member 24 forming its rear side, to which the circuit board 20 is attached. Covering the front side of the housing is a somewhat irregular shaped front member 26. The latter is fixed as by bonding to lower and side edges 28 and 30 of the rear member and to an upper edge portion 32 and it extends over the batteries 22 and the light bulb 18. A clear plastic portion 34 is located in front of the light bulb to serve as a protective lens for the bulb.

The light bulb is situated above the circuit board 20 and in front of an elongated depression in the base member that forms the chamber 16. A layer of reflective material 36 is provided on the surface of the depression to increase light reflectivity.

Attached to the rigid rear or base member 24, is a suitable attachment means such as a clip 38 or the like to enable the module to be mounted or attached to structure such as in a purse. Other forms of attachment devices could be used, if desired.

As seen, the overall construction of the light module 10 is relatively simple and compact. Although dimensions may vary to suit different lighting and installation requirements, the module 10 embodying principles of the invention may have a plan form size as small as approximately one-half the size of a standard credit card and a thickness as small as 0.25 inches, thereby enabling a module to be installed in a wide range of confined and/or normally inaccessible locations.

Figure 5:
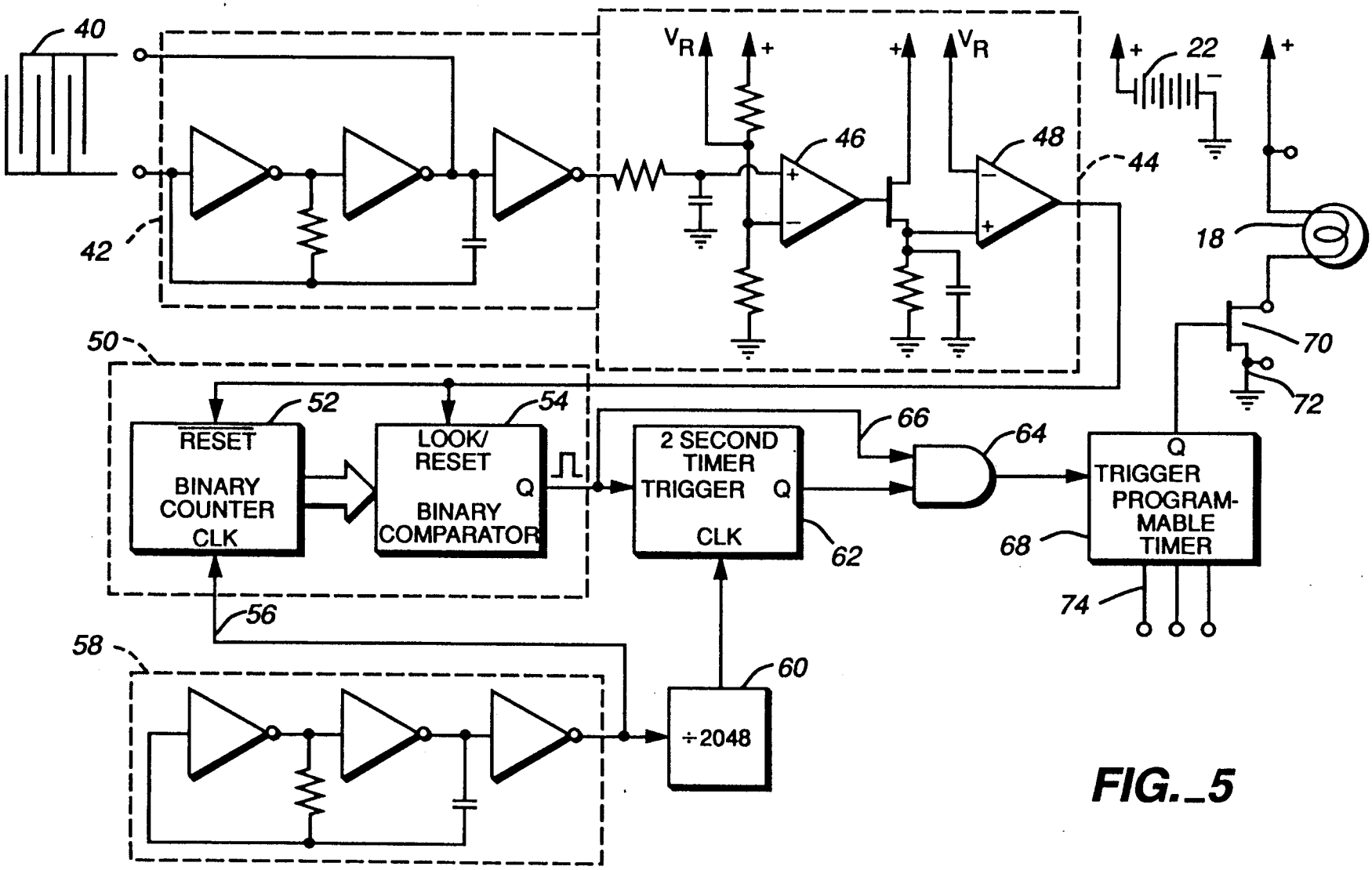
FIG. 5 is a flow diagram describing the operation of the light module of FIGS. 1–4.

The on-off control circuit for the light module 10 according to the invention is shown in FIG. 5. A sensor 40, comprising a series of capacitor plates is connected to a conventional oscillator 42 (e.g. 30 KHZ) comprised of three amplifier elements in series. Connected to the oscillator is a frequency shift detector 44 of a well known type comprised of a pair of comparators 46 and 48. Each comparator is comprised of an op-amp having plus and minus inputs. The output of the second comparator is connected to a valid touch timer 50 comprised of a parallel connected first reset binary counter 52 and a look/reset binary comparator 54. The reset binary counter 52 also receives an output via a lead 56 from a second oscillator 58 (e.g. 20 KHZ) also comprised of three amplifier elements connected in series. The output from oscillator 58 is also furnished to a divider 60 which converts the oscillator to a lower clock frequency and furnishes a clock signal to a two-second timer 62.

The output from the binary comparator 54 is furnished both to the two-second timer 62 and also as one input via a lead 66 to an And Gate 64. A second input to this And Gate is provided directly from the two-second timer.

The output produced from And Gate 64 after it receives both inputs is furnished to a programmable timer 68 which can be set to operate for different preselected time periods (e.g. 5, 10, 15, 20, 30 or 60 seconds) on and then off. The output from the programmable timer is furnished to the base of a single transistor 70 which functions as a lamp driver. One of the other two terminals of the transistor is connected via a lead 72 to ground potential and the other terminal is connected to one terminal of the light bulb 18 socket whose other terminal is connected to the battery 22.

Figure 6:
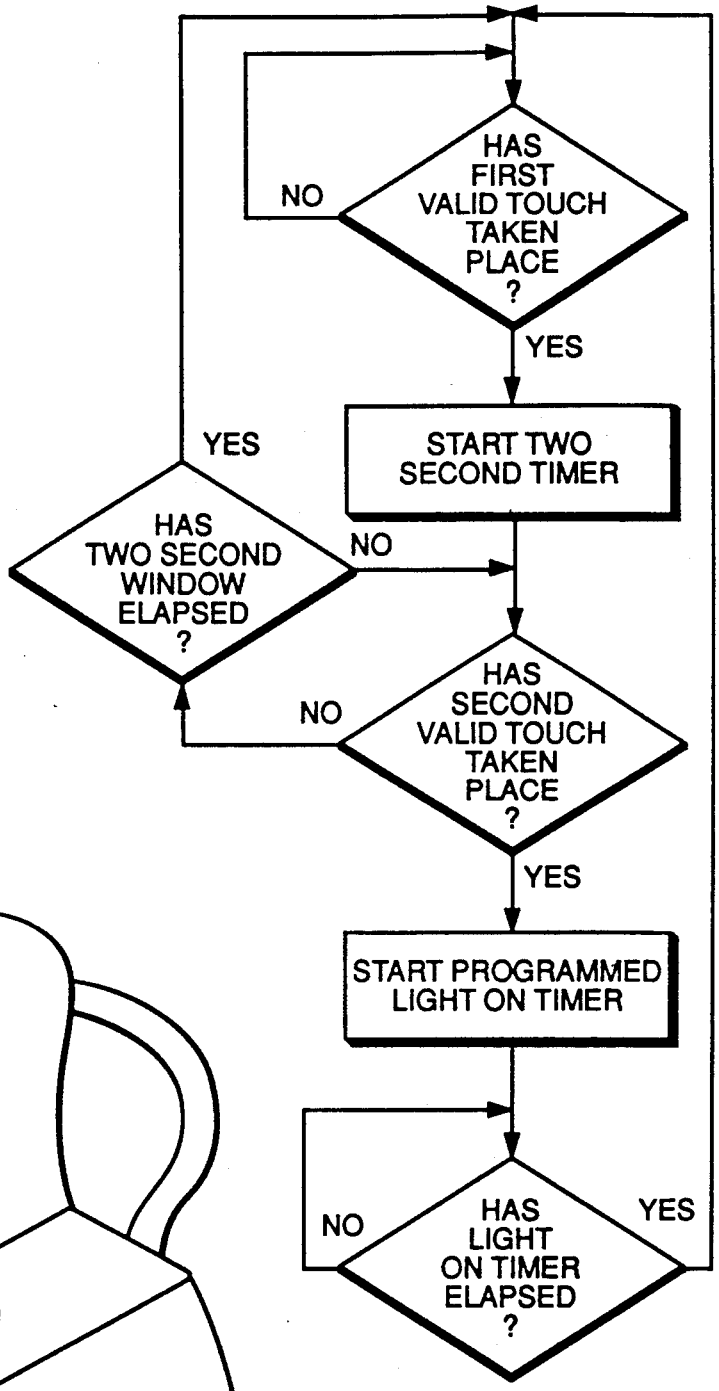
FIG. 6 is a circuit diagram for the light module of the present invention.

The operation of light module 10 in a typical installation may be best explained by reference to FIG. 5 and also to the flow diagram of FIG. 6. When an object, which is made of material that will change the effective capacitance of the sensor (such as a human finger), is in close proximity to the sensor 40 the frequency of the free running oscillator 42 is then changed. This change is sensed by a frequency shift detector 44 and it triggers the valid touch timer 50. The latter is preset so that it must be greater than 200 milliseconds but less than one second. This is the time required for a "valid touch". The two hundred millisecond timer triggers the two-second timer 62 and the end of the first valid touch initiates a two-second look window. During this look window a second valid touch must be sensed in order to turn the light on.

At this point, the output of the control circuit turns on the lamp 18. When the second valid touch is sensed and no more valid touches are sensed within the two-second window, the programmable timer 68 (e.g. a ten second timer) is triggered and keeps the light 18 on for the preset (ten seconds) duration. The control circuit may have a plurality of outlets 74 for multiple light on-times allowing for models with differing on times.

From the foregoing it is seen that the present invention provides a light module which can be activated to turn-on by a touch sensor preferably requiring two touches within a limited time span. Thereafter, the light module will turn-off automatically after a preset time period to conserve power.

The preferred embodiment described herein is intended to be purely illustrative, and not limiting of the scope of the invention. Other embodiments and variations will be apparent to those skilled in the art and may be made without departing from the essence and scope of the invention as defined in the following claims.

What is claimed is:

1. A light module adapted to provide light temporarily in a confined space comprising:

means for providing a source of light;

power means sufficient to activate said light source means;

electrical circuit means connected to said light source means and said power means;

touch sensitive switch means in said circuit means including proximity sensor means and means for requiring at least one touch of said sensor means by a user for closing a circuit between said light source means and said power means to turn on said light source means; and timer means connected to said switch means for opening said circuit to automatically turn off said light source means a predetermined period of time after the circuit is first closed.

2. The light module as described in claim wherein said touch sensitive switch means includes means for requiring two touches of said sensor means by a user within a predetermined time period before said circuit is closed to activate said light source means.

3. The light module as described in claim 2 wherein said means for requiring two touches of said sensor means comprises a valid touch timer means for verifying two touches within a time period, a two-second timer and an And gate for receiving inputs from said valid touch timer and said two-second timer.

4. The light module as described in claim 1 including a relatively thin, oblong shaped housing for retaining said light source means, said power means and said electrical circuit means.

5. The light module as described in claim 1 including a relatively rigid but thin base member forming a base member and a reflective chamber for said light source means, a circuit board on said base for retaining said circuit means and said power means, and a frontal member attached to said base member and having a transparent window spaced from said reflective chamber.

6. The light module as described in claim 5 including a mounting means fixed to an outer side of said base member.

7. The light module as described in claim 5 wherein said frontal member is made of a relatively thin plastic material.

* * * * *